US007207876B2

(12) United States Patent
Hoffheimer

(10) Patent No.: US 7,207,876 B2
(45) Date of Patent: Apr. 24, 2007

(54) FLAP WHEEL AND METHOD

(75) Inventor: Craig R. Hoffheimer, Wyoming, OH (US)

(73) Assignee: Jason Incorporated, Conover, NC (US)

( * ) Notice: Subject to any disclaimer, the term of this patent is extended or adjusted under 35 U.S.C. 154(b) by 0 days.

(21) Appl. No.: 10/870,759

(22) Filed: Jun. 17, 2004

(65) Prior Publication Data

US 2005/0282478 A1 Dec. 22, 2005

(51) Int. Cl.
*B24D 9/02* (2006.01)

(52) U.S. Cl. ..... 451/466; 451/542; 451/468

(58) Field of Classification Search ..... 451/466, 451/468, 469, 532–537, 542
See application file for complete search history.

(56) References Cited

U.S. PATENT DOCUMENTS

| | | | | |
|---|---|---|---|---|
| 2,259,475 | A | 10/1941 | Koether | |
| 2,651,894 | A | 9/1953 | Leggett | |
| RE25,025 | E | 8/1961 | Bernstein et al. | |
| RE25,026 | E | 8/1961 | Bernstein et al. | |
| 3,058,269 | A | 10/1962 | Block | |
| 3,109,267 | A | 11/1963 | Block | |
| 3,132,452 | A | 5/1964 | Block | |
| 3,466,816 | A | 9/1969 | Block | |
| 3,512,311 | A | 5/1970 | Block | |
| 3,533,198 | A | 10/1970 | Burns | |
| 3,548,551 | A | 12/1970 | Block | |
| 3,648,417 | A | 3/1972 | Block | |
| 3,653,856 | A | 4/1972 | Field | |
| 3,678,633 | A | 7/1972 | Block | |
| 3,711,261 | A | 1/1973 | Burns | |
| 3,795,498 | A | 3/1974 | Hasegawa | |
| 3,872,630 | A | 3/1975 | Ali | |
| 3,890,746 | A | 6/1975 | Saegusa et al. | |
| 4,080,714 | A | 3/1978 | Emerson | |
| 4,872,292 | A | 10/1989 | Block | |
| 4,882,879 | A | 11/1989 | Warner et al. | |
| 4,993,198 | A * | 2/1991 | Hotani | 451/342 |
| 5,396,680 | A * | 3/1995 | Belanger | 15/230.16 |
| 5,588,172 | A | 12/1996 | Biocca | |
| 5,649,857 | A * | 7/1997 | Suhrheinrich et al. | 451/466 |
| 5,707,278 | A | 1/1998 | Korn | |
| 5,722,881 | A | 3/1998 | Emerson | |
| 5,903,951 | A | 5/1999 | Ionta et al. | |
| 6,309,292 | B1 * | 10/2001 | Montabaur et al. | 451/542 |
| 6,592,442 | B2 * | 7/2003 | Hoffheimer | 451/466 |
| 2002/0086631 | A1 * | 7/2002 | Hoffheimer | 451/466 |

FOREIGN PATENT DOCUMENTS

DE 39 20971 A1 1/1990

OTHER PUBLICATIONS

*Merit Abrasive Products.*, Catalog No. 16, Aug. 15, 1979, 66 pgs.

* cited by examiner

*Primary Examiner*—Lee D. Wilson
(74) *Attorney, Agent, or Firm*—John W. Renner; Renner, Otto, Boisselle & Sklar

(57) ABSTRACT

A flap wheel includes a hub with axially extending slots for receiving discrete packs, each pack including a clip receivable in the slot with walls projecting beyond the slot, and end caps fitting on the ends of the hub and including fingers interlaced with the ends of projecting packs projecting beyond the hub and dampening vibrations between the hub and packs. The end caps not only confine the flap packs in the hub slots, but also engage the projecting ends of the flap packs to dampen vibrations between the flap packs and the hub, and center the hub and tool on its axis of rotation.

28 Claims, 5 Drawing Sheets

FLAP WHEEL AND METHOD

DISCLOSURE

This invention relates generally as indicated to a flap wheel and method, and more particularly to a finishing and abrading wheel having improved life and service characteristics, and to a method of dampening vibrations of the flaps with respect to the hub in which they are mounted.

BACKGROUND OF THE INVENTION

Flap wheels include discrete packs of abrasive or polishing sheet materials which are mounted in a rotary hub in turn mounted on a power driven arbor. Some packs are hinged to the hub while others fit in slots in the periphery, which slots are usually axial or slightly helical.

The packs are preassembled and mounted in clips which in turn fit in the slots or which are hinged to the hub. The clips are typically provided with relatively thin projecting side walls and the pack components are held to each other and to the clips by fasteners such as staples which extend through the side walls and the inner edge of the pack components embraced by the walls.

Because of the fasteners the walls of the clip normally project beyond the slots in the hub. An example of a flap pack and clip assembly fitting in a hub slot may be seen in applicants prior U.S. Pat. No. 6,592,442 B2.

In operation the tool is rotated with some pressure against the work being abraded or finished and the packs are the wear replacement parts. When worn the tool is disassembled and the old worn packs are removed and replaced by new packs. The end plates are removed and the worn packs are slid out of the slots, new packs are inserted into the slots, and the end plates are replaced. The amount of time the tool is down and the time and effort it takes to remove and replace the packs is important to the productivity of the tool.

That the packs be easily slid in and out of the slots is important to facilitate and reduce the amount of time a replacement requires. Also, because of the normal manufacturing tolerances in the manufacture of the packs, the clearance between the slot and pack can't be too close, otherwise disassembly and assembly would be inordinately slow and may even require special tools. It is primarily for this reason that there is a fairly wide tolerance between the slot and pack-clip assembly.

Unfortunately this tolerance creates a vibration of the pack within the slot when the tool is in use and being pressed against the work. This is in part caused by the fact that the pack engages the work once per revolution and when not engaging the work centrifugal force tends to straighten out the pack creating a relatively high frequency vibration.

It has been found with testing that this vibration tends to create stress fractures in the metal pack clip, particularly near the confining slot of the hub outer corners.

Extending the slot radially to embrace more of the clip to provide better support is not practical because of the fasteners or staples extending through the clip walls which tend to project in an irregular fashion. It would however be desirable if the vibrations of the packs within the slots could be dampened without affecting the tolerance and the ease of assembly and disassembly of the hub and packs. This would increase the useful life of the packs while not increasing the time or effort needed for pack replacement.

SUMMARY OF THE INVENTION

With the present invention there is provided a rotary flap wheel that includes end plates or caps which include axially inwardly projecting wedge pressure fingers or teeth which project between the ends of the flaps projecting from the hub and engage the flap packs, and more particularly the flap clip walls to dampen such vibrations.

The fingers project axially far enough to engage the clip walls of the flap packs but not far enough to interfere with any projecting fastener such as a staple.

The end caps include a central slightly inwardly axially projecting shoulder which seats in the center of the hub. The shoulder and the fingers form an annular groove in which the end of the hub is seated and which locks the packs against axial movement with respect to the hub and pack receiving slots. The shoulder also centers the hub with respect to the mandrel axis which is the axis of rotation of the tool.

The slots and packs extend at a uniform angle with respect to a radius of the hub so that the fingers of the end caps are also at such common angle to interlace properly with the ends of the packs projecting beyond the hub. The pack materials such as sheets of sandpaper or abrasive cloth may be pre-bent to curve in the direction of such common angle or away from the direction of rotation. Because of this angle deviation of the packs the end caps on opposite ends of the hub are mirror images of each other so that the axially inwardly extending pressure fingers will properly engage and interlace with the outwardly projecting ends of the packs. The fingers or teeth have a slight wedge configuration both axially and radially which makes the assembly easy to assembly and disassemble, and when assembled, enables the end caps to engage and embrace the ends of the packs reducing or dampening vibrations which would shorten the life of the tool. The more pronounced wedge configuration is radially.

This pronounced wedge configuration of the fingers assists in directing and maintaining the direction and curvature of the flap packs angled away from the direction of rotation exposing a significant portion of the abrasive surface at the working edge of each sheet. This additional support and control for the flap packs when pre-curved causes the flap packs mutually to support each other, with the downstream pack underlying and resiliently supporting the upstream adjacent pack, thus further reducing and dampening vibrations.

The inwardly projecting fingers of the end caps form slots which embrace the projecting flap pack ends. In this manner the slots of the end caps and hub are aligned and held in such alignment by the flap packs as keys.

As the end caps are clamped against the ends of the hub the ends of the flap packs projecting outwardly from the hub are embraced by the finger-slot construction of the end caps and the clamping of the end plates will engage each end of the flap packs on each side providing a method of dampening vibrations of the flap packs within the slots of the hub, significantly increasing the life of the packs and the operational cycle of the tool.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
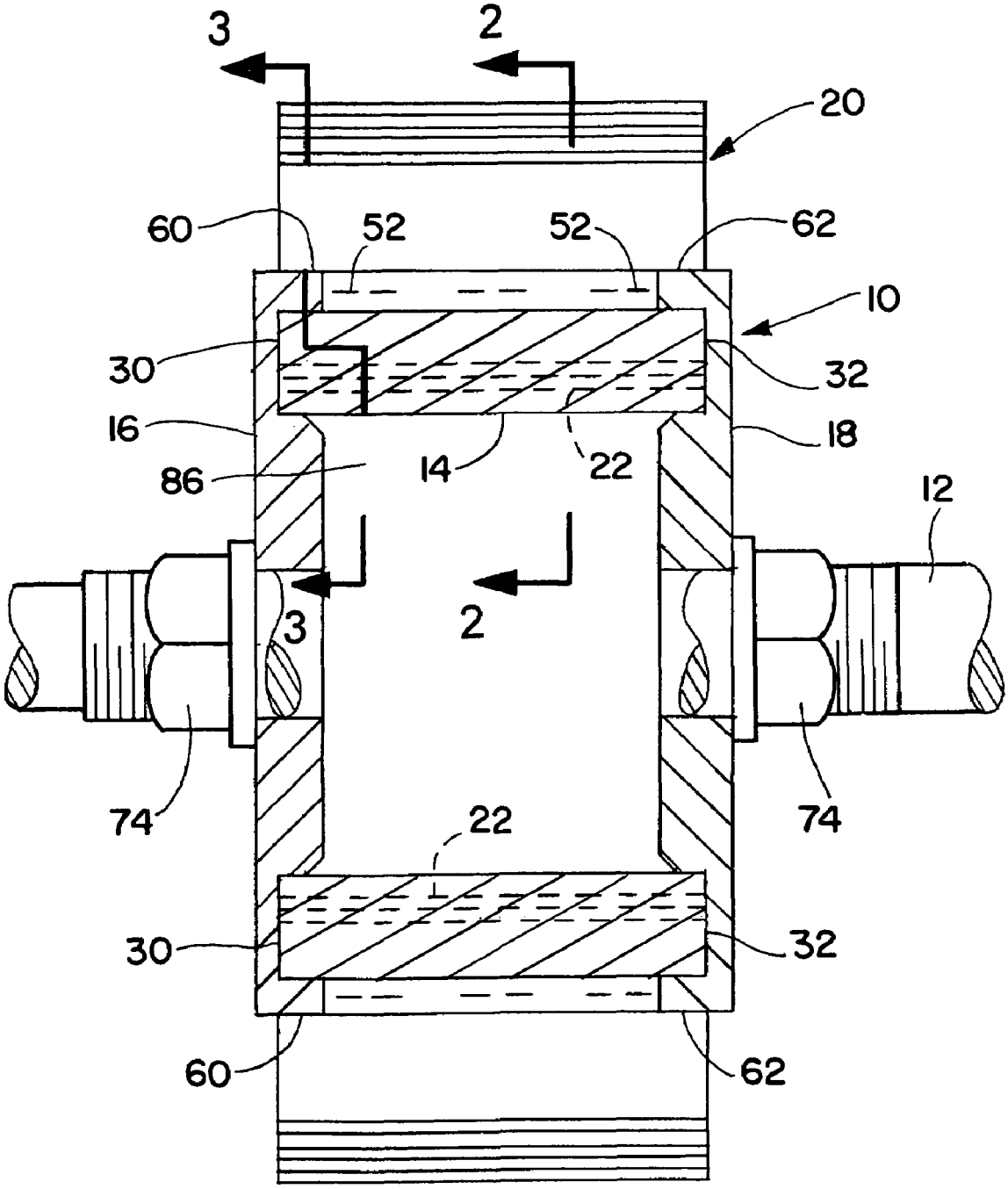
FIG. 1 is an axial section of a flap wheel in accordance with the invention shown mounted on a drive mandrel which is partly broken away.

Referring first to FIG. 1 there is illustrated a flap wheel shown generally at 10, which is mounted on a power driven mandrel shown generally at 12 for rotation on the axis of the mandrel.

The flap wheel tool comprises a generally cylindrical hub shown at 14, two opposite end caps 16 and 18, and a series of flap packs shown generally at 20 extending outwardly from the hub.

Figure 2:
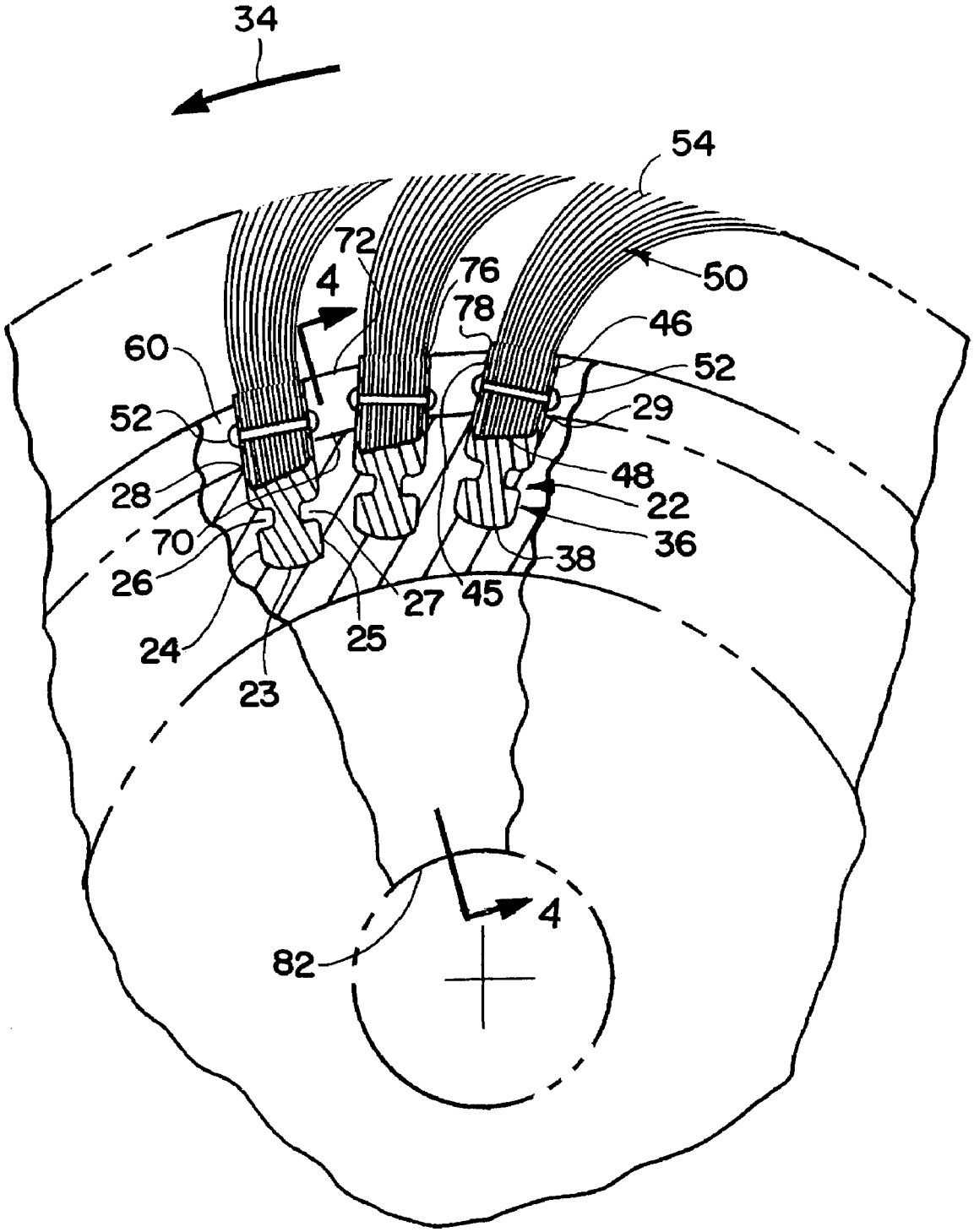
FIG. 2 is a fragmentary trans-axial section of the hub, flaps and end cap fingers taken generally from the line 2—2 of FIG. 1.
Figure 3:
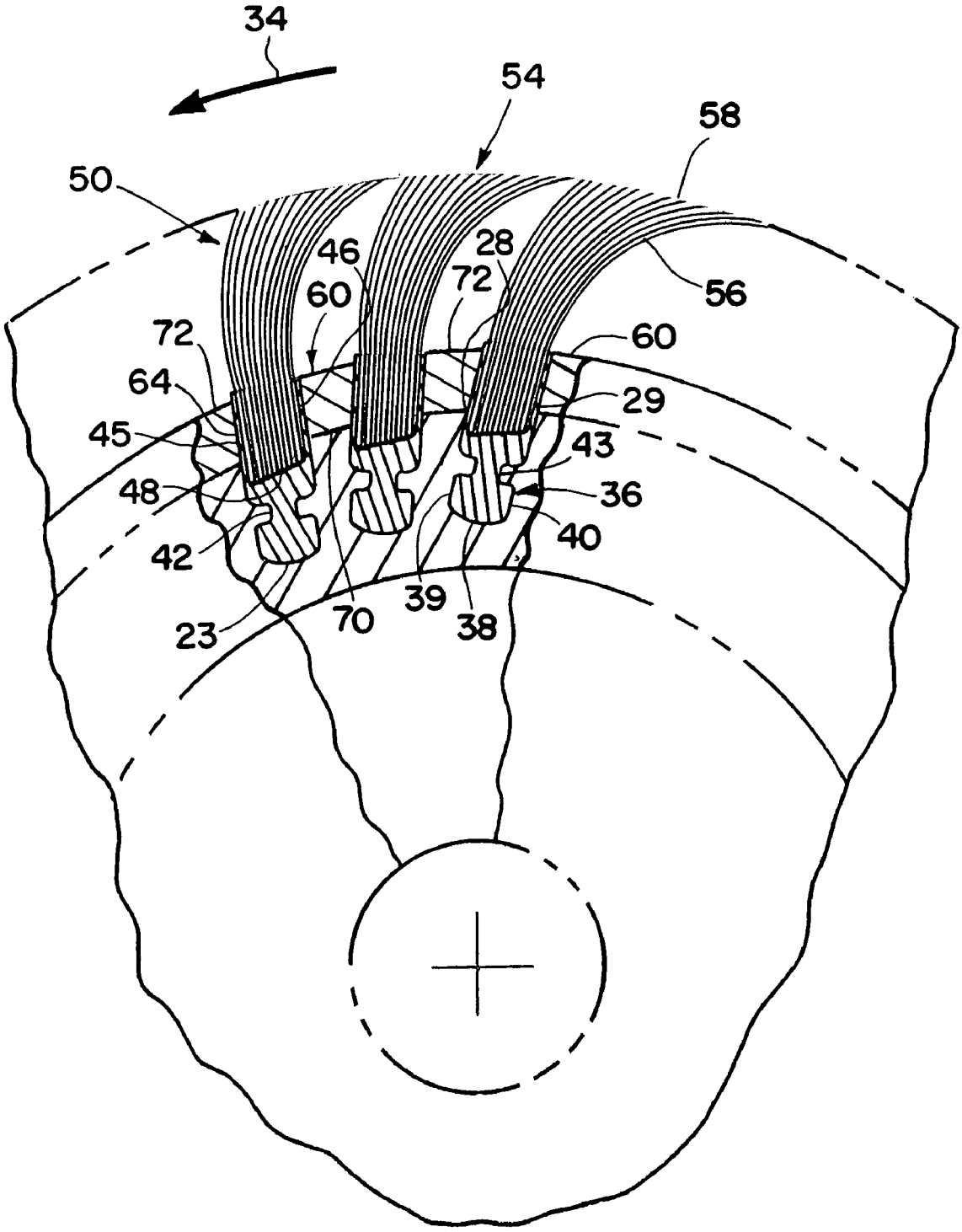
FIG. 3 is a similar fragmentary section through the fingers taken generally from the line 3—3 of FIG. 1.
Figure 4:
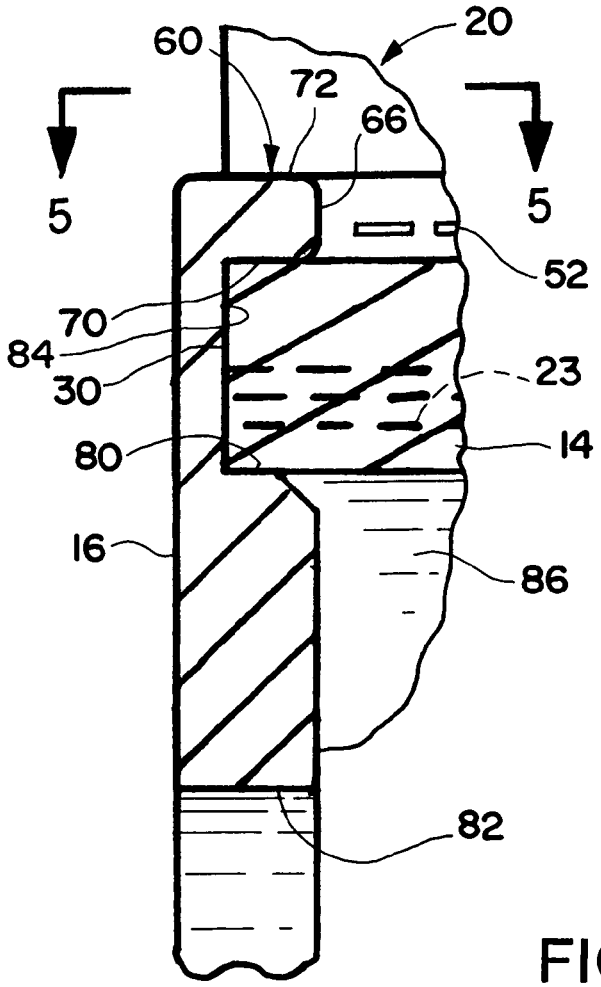
FIG. 4 is an enlarged fragmentary radial section of one end of the hub taken from the line 4—4 of FIG. 2.

Referring now additionally to FIGS. 2–5, and more particularly to FIGS. 2 and 3, it will be seen that the hub 14 is provided with a series of axially extending equally circumferentially spaced slots shown generally at 22. These slots have a transverse profile which includes an inner curved bottom 23 with generally parallel side walls 24 and 25 which are interrupted by inward key-like projections extending from each side of the slot as seen at 26 and 27. The slots continue to the periphery of the hub at the slot corners 28 and 29. The slots extend axially through the hub from one end 30 to the other end 32 as seen in FIG. 1.

It is noted that the slots do not extend radially but at a common skew angle to a radius so that the slots are directed away from the direction of rotation of the tool which is shown by the arrow 34 in FIGS. 2 and 3. This angle is preferably about 15° but may vary from about 10° to about 20°.

The slots are designed to accommodate clips shown generally at 36 which are part of the flap pack assemblies 20. The clips have a transverse profile generally imitating that of the slots and include a rounded bottom 38 with generally parallel side walls 39 and 40. These side walls are however provided with opposite grooves or slots 42 and 43 which form key-ways accommodating the keys or projections 26 and 27 extending from the slot side walls.

Each clip includes pack accommodating relatively thin projecting side walls 45 and 46 which are joined by a skewed pack inner edge receiving base wall 48. It is the slot formed by the side walls and the skewed base wall which receives the pack forming layers or sheets seen at 50. These sheet packs are held to the clips by fasteners such as staples 52 which extend through the side walls of the clips and the inner edges of the pack sheets. The staples are inserted through the walls of the clip which normally project beyond the hub. While the tolerance between the hub slot and clip is designed to be fairly wide to enable the flap packs to be slid into and out of the slots, the slots won't accommodate the fasteners.

It is noted that the skewed bottom wall of the clip arranges the outer edges of the sheets or elements in the same laid back or skewed open fashion as seen at 54. This then exposes the outer edges of the sheets facing the direction of rotation to the work. This would be the side of the sheets on the left hand side of the packs seen in FIGS. 2 and 3 or facing the direction of rotation.

It has been found that this outer edge exposure of the sheets or elements can further be enhanced by providing the flap packs with a preset curvature away from the direction of rotation as seen at 56 in FIG. 3. This preset curvature of the packs exposes an even greater surface area of the counter clockwise side as seen at 58 of the outer edge of the sheets or elements which engages the work. Also this pre-curvature away from the direction of rotation provides better control and support in that the flap packs mutually support each other with the down stream pack (away from the direction of rotation) underlying and resiliently supporting the upstream adjacent pack. The packs act like underlying leaf springs for each other.

The elements or sheets of the packs may vary widely such as sisal, non-woven abrasive, abrasive belt material, polishing cloths, coated abrasives such as sandpaper or emery cloth, or mixtures thereof. If coated abrasives are employed the side facing the direction of rotation will normally contain the abrasive.

While the pre-curving of the flap packs tends to dampen vibrations of the flap packs with respect to the hub, the end caps 16 and 18 each include an annular row of teeth or fingers shown at 60 and 62, respectively. These teeth or fingers project axially inwardly and engage the sides of the ends of the flap packs projecting outwardly of the hub 14 and more particularly the clips. As seen more clearly in FIGS. 2, 3 and 5, the axially inwardly projecting fingers form slots between them indicated at 64, accommodating the ends of the flap packs 20, and these slots are aligned with the slots in the hub, and at the same skewed angle.

Figure 5:
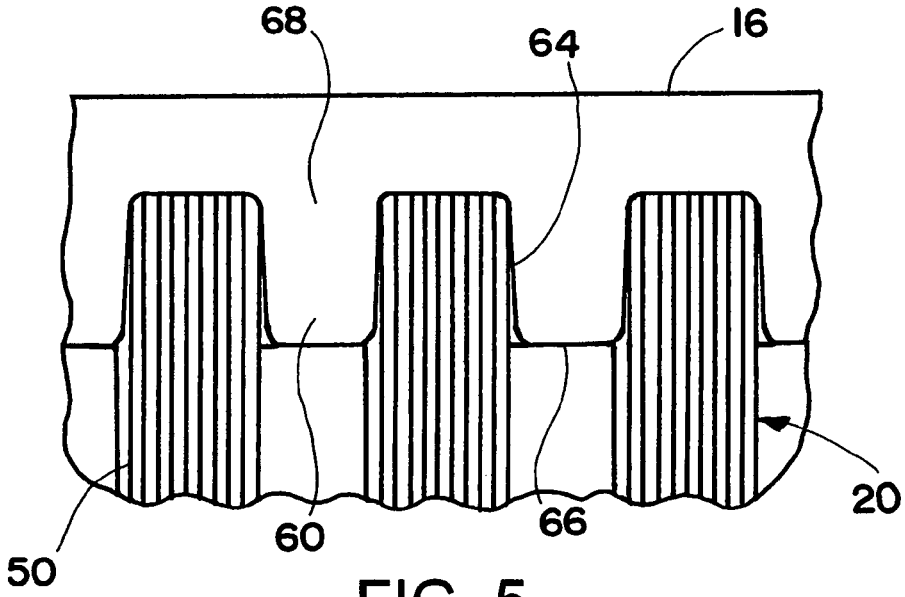
FIG. 5 is an enlarged fragmentary view of the fingers in radial elevation as taken from the line 5—5 of FIG. 4.

In viewing the projecting fingers from the radial exterior as seen in FIG. 5, it will be seen that the distal ends of the fingers 66 are slightly more narrow than the proximal ends 68. This slight taper facilitates the assembly of the parts.

Also in looking at the projecting fingers axially as seen in FIGS. 2 and 3 it will be seen that the fingers have a more pronounced wedge tapered configuration. The inner edge of the fingers seen at 70 is substantially smaller than the outer edge 72. This pronounced wedge configuration ensures proper engagement of the parts as the end caps are tightened on the mandrel by one or more of the nuts 74 seen in FIG. 1.

Also seen in FIG. 1, the fingers 60 and 62 do not project axially far enough to interfere with the staples or fasteners seen at 52 which extend through the clip walls. This makes the components easier to assemble and disassemble.

With reference to FIGS. 2 and 3 it will be seen that the fingers extend radially to the approximate edge of the clip wall on the upstream side of the flap but just below the clip wall edge on the downstream side. These two edges are seen at 76 and 78 in FIG. 2. This slight variance is due to the angle of the clip with respect to the radius. The fingers however engage the projecting clip walls and provide vibration dampening between the hub and flap packs providing significantly longer working cycles between flap pack changes.

It is noted that the end caps 16 and 18 are also provided with annular shoulders 80 which are centered with respect to the mandrel hole 82. It will be appreciated that the hole 82 will accommodate different types and sizes of mandrels, and bushings or sleeves may be employed. Annual grooves 84 are formed by the end caps between the shoulders 80 and the outer row of fingers. The interior 86 of the hub seats on the shoulders 80 centering the hub on the mandrel while the ends 30 and 32 of the hub seat in the annular grooves 84.

Figure 6:
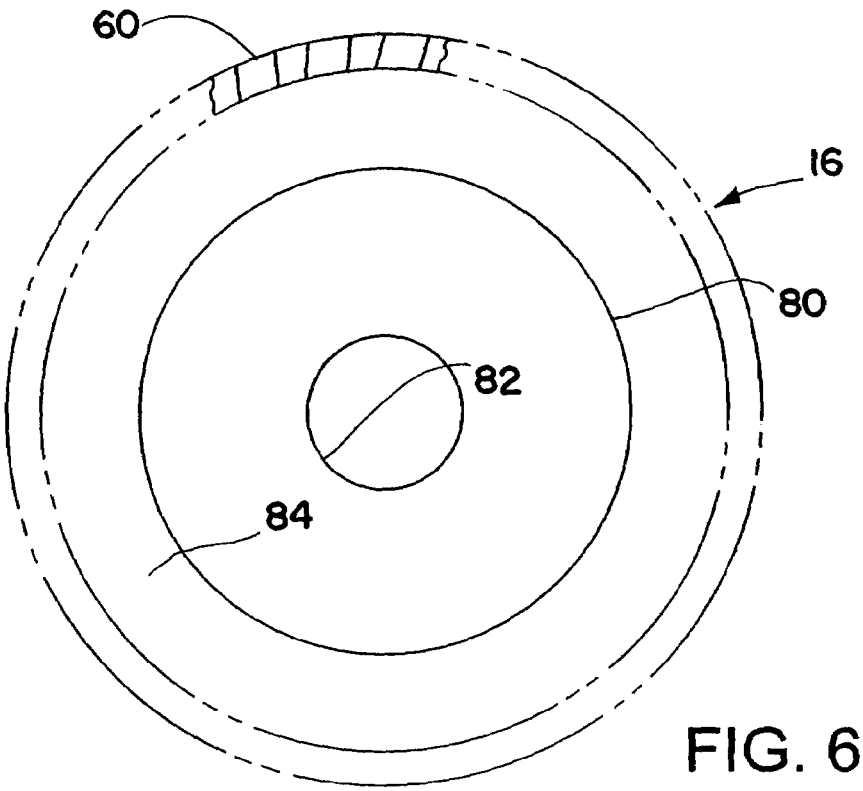
FIG. 6 is an axial plan view of one of the end caps.
Figure 7:
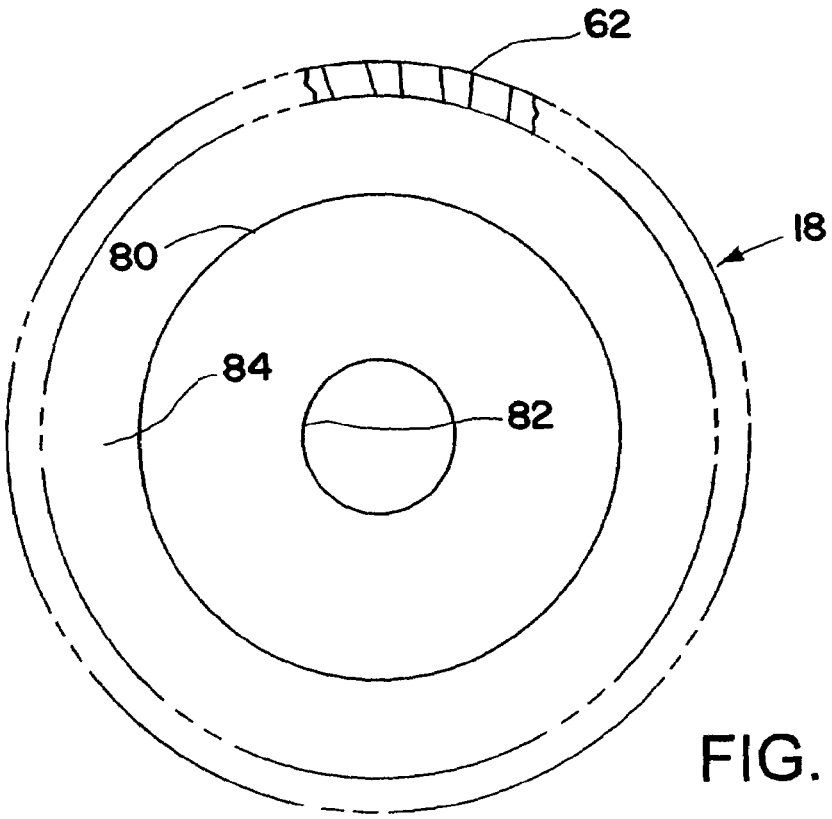
FIG. 7 is an axial opposite plan view of the other end cap.

In comparing FIGS. 6 and 7 it will be seen that the two end caps are generally similar each having a mandrel hole 82, shoulder 80, and annular groove 84, but the inwardly projecting annular row of pressure fingers are not the same. The fingers 60 and 62 are mirror images of each other when viewed axially as seen.

The end caps when assembled and tightened on the mandrel center the hub, close the ends of the slots in the hub, and engage the ends of the flap packs to take up any play or looseness which may cause vibration providing a longer useful working cycle.

Although FIG. 1 shows a tool of nominal axial width, it will be appreciated that the axial width of the tool may be varied by changing the axial length of the hub and the flap packs therein. Also, although the hub and end caps or plates are preferably formed of metal, it will be appreciated that they may also be formed of plastics or composites, for example. However, anodized aluminum for the end caps, hub, and clips is preferred since they are more easily recylcled.

It can now be seen that there is provided a rotary flap wheel with a longer useful life and improved service characteristics but which can easily be assembled and disassembled for pack replacement.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

The invention claimed is:

1. A flap wheel comprising a cylindrical rotational hub with generally axially extending peripheral slots for receiving flap packs, and end caps for said hub having axially projecting fingers to project between and confine the ends of the flap packs to dampen vibration of the flap packs as the wheel rotates.

2. A flap wheel as set forth in claim 1 wherein said fingers project axially inwardly from the end caps and are more narrow at their distal ends.

3. A flap wheel as set forth in claim 2 wherein said slots, fingers and flap packs extend at a common angle to a radius of the hub away from the direction of rotation.

4. A flap wheel as set forth in claim 3 wherein the flap packs are packs of abrasive elements and are curved away from the direction of rotation to expose a greater portion of the outer edge of each element in the pack.

5. A flap wheel as set forth in claim 3 wherein the flap packs in the pack are curved away from the direction of rotation so that adjacent flap packs overlie each other providing mutual support.

6. A flap wheel as set forth in claim 3 wherein the end caps at opposite ends of said hub are mirror images of each other.

7. A flap wheel as set forth in claim 6 wherein each end cap includes an inwardly projecting shoulder fitting closely within the hub, the exterior of the shoulder and the fingers forming a circumferential groove to seat against the end of the hub and lock the packs against axial movement in the slots.

8. A flap wheel as set forth in claim 1 including clips for forming said flap packs, said clips fitting in said slots and including generally radially projecting walls extending beyond the hub, said fingers engaging said walls at the ends of the flap packs.

9. A flap wheel as set forth in claim 8 wherein said fingers project radially to the approximate extent of the walls.

10. A flap wheel as set forth in claim 9 including fasteners extending through said walls to secure the pack and clip, said fasteners being positioned between the distal ends of the fingers of opposite end caps.

11. A flap wheel as set forth in claim 9 wherein said fingers between said packs project radially substantially to the extent of the wall on the clip of one pack between which the finger is positioned but extend beyond the wall of the clip of the other pack.

12. A flap wheel as set forth in claim 11 wherein said slots, end cap projections and flap packs extend at a common angle to a radius of the hub.

13. A flap wheel as set forth in claim 12 wherein the flap packs include a bundle of elements and are curved away from the direction of rotation to expose a greater portion of the outer edge of each element in the pack.

14. A flap wheel as set forth in claim 12 wherein the flap packs are curved away from the direction of rotation so that adjacent flap packs overlie each other providing mutual support.

15. A flap wheel as set forth in claim 12 wherein the end caps at opposite ends of the hub are mirror images of each other.

16. A flap wheel comprising a cylindrical hub with generally axially extending slots in the circumference of the hub, for receiving flap packs, generally radially projecting flap packs in said slots and end caps for said hub including axial projections extending radially beyond the hub and fitting between the axial ends of the radially projecting flap packs to dampen vibrations of the flap packs as the wheel rotates.

17. A flap wheel as set forth in claim 16 wherein said axial projections of said end caps interlace with the axial ends of the flap packs and are generally wedge shape.

18. A flap wheel as set forth in claim 17 including clips for forming said flap packs, each including generally radially projecting walls extending radially beyond the hub, said end cap axial projections engaging the walls at the ends of the flap packs.

19. A flap wheel as set forth in claim 18 wherein each said end cap projection projects radially to the approximate extent of the projecting walls of the clip.

20. A flap wheel as set forth in claim 19 including fasteners extending through the walls to secure the pack and clip, the fasteners being positioned between the distal ends of said end cap projections.

21. A flap wheel as set forth in claim 17 wherein said axial projections between said packs project radially substantially to the extent of the wall on the clip of one pack between which it is positioned but extend beyond the wall of the clip of the other pack.

22. A flap wheel as set forth in claim 16 wherein each end cap includes an inwardly projecting shoulder fitting closely within the hub, the exterior of the shoulder and the axial projections forming a circumferential groove to seat against the end of the hub and lock the packs against axial movement in the slots.

23. A flap wheel as set forth in claim 16 including slots between said axial projections generally aligned with the slots of the hub receiving the projecting packs.

24. A flap wheel as set forth in claim 23 wherein the slots in the caps and hub are aligned.

25. In a flap wheel having flap packs inserted in slots and projecting radially from a hub, a method of dampening vibrations of the flap packs within the slots as the wheel rotates by clamping ends caps on the hub to grip at least a portion of the flap pack projecting radially from the hub.

26. A method as set forth in claim 25 including the step of providing the end caps with slots within which the ends of the flap packs are seated.

27. A method as set forth in claim 25 including the step of providing the end caps with fingers which engage and project between the flap packs.

28. A method as set forth in claim 25 wherein the end caps clamp against the ends of the hub but grip sides of the flap packs radially beyond the hub.

* * * * *